US005361660A

United States Patent [19]

Tsubota

[11] Patent Number: 5,361,660

[45] Date of Patent: Nov. 8, 1994

[54] METHOD OF AND APPARATUS FOR FEEDING OIL TO A TURRET PUNCH PRESS

[75] Inventor: Takayoshi Tsubota, Kobe, Japan

[73] Assignee: Tsubota Technica Co., Ltd., Kobe, Japan

[21] Appl. No.: 24,318

[22] Filed: Mar. 1, 1993

[30] Foreign Application Priority Data

Apr. 15, 1992 [JP] Japan ..... 4-122618

[51] Int. Cl.[5] ..... B26D 7/08; B26F 1/04

[52] U.S. Cl. ..... 83/55; 83/22; 83/169; 83/171

[58] Field of Search ..... 83/169, 168, 170, 13, 83/50, 55, 22, 13

[56] References Cited

U.S. PATENT DOCUMENTS

| | | | |
|---|---|---|---|
| 2,936,802 | 5/1960 | Skoog | 83/169 |
| 3,800,643 | 4/1974 | Scott et al. | 83/169 |
| 4,292,869 | 10/1981 | Wallis | 83/169 |
| 4,872,381 | 10/1989 | Stroms | 83/100 |
| 4,977,804 | 12/1990 | Naito | 83/169 |

FOREIGN PATENT DOCUMENTS

| | | | |
|---|---|---|---|
| 722760 | 3/1932 | France | 83/169 |
| 890590 | 2/1944 | France | 83/169 |
| 0044484 | 4/1977 | Japan | 83/169 |

*Primary Examiner*—Hien H. Phan
*Attorney, Agent, or Firm*—Wenderoth, Lind & Ponack

[57] ABSTRACT

A method and apparatus are disclosed for feeding oil to a turret punch press in which an upper tool is adapted to be repeatedly moved vertically relative to a lower tool formed at the upper end of a cylindrical die. Conventional hand lubrication or the like can be carried out in order to feed lubricating oil to the contact surfaces at which the upper tool and a supporting member therefor make sliding contact with one another. A material is positioned on the upper face of the cylindrical die so as to mask the cylindrical die. Atomized cutting oil is periodically fed to the inside space of the cylindrical die, and is prevented from escaping therefrom due to the presence of the material before punching of the material and due to the extension of the upper tool into the lower tool after punching of the material has been carried out.

19 Claims, 3 Drawing Sheets

METHOD OF AND APPARATUS FOR FEEDING OIL TO A TURRET PUNCH PRESS

BACKGROUND OF THE INVENTION

The present invention relates to an oil feeder for a machine tool, and more particularly to a method of and an apparatus for feeding cutting oil to a turret punch press.

One well known type of a turret punch press 1 is shown in FIG. 3. This turret punch press 1 comprises an upper rotatable turret 2, a sleeve 5 slidably received in the upper rotatable turret 2, a punch body 4 slidably received in the sleeve 5 and having an upper tool 3 on its lower end which is slidably extendable through a bottom end of the sleeve 5, a lower rotatable turret 6, and a cylindrical die 11 fastened to the lower turret 6 and comprising a lower tool 7. A material A is interposed between the upper and lower turrets 2 and 6 and superposed on the upper face of the lower tool 7. A flange 8 provided on the upper end of the sleeve 5 determines the extent to which the sleeve 5 can be vertically lowered. A compression spring 10 is interposed between the flange 8 and another flange 9 provided on the upper end of the punch body 4, such that the punch body 4 is biased upwardly. In order to effect punching, a striking force is exerted on the upper end face of the punch body 4 by a hammer 12 disposed over the punch body 4, such that the punch body 4 is vertically lowered to such an extent that the upper tool 3 fits in the lower tool 7.

In a turret punch press of this type, the sleeve 5 is in sliding contact with the punch body 4, and the upper turret 2 is in sliding contact with the sleeve 5. Thus, it is conventionally considered necessary to periodically manually feed lubricating oil between these contact surfaces. In addition, it has been necessary to provide cutting oil to the upper tool 3 and the lower tool 7, and in attempting to do so, many difficulties have been encountered. In order to prevent these tools from seizing up on each other, it is most common to apply cutting oil to the surfaces of material A.

In order to feed the lubricating oil more efficiently, it is also common to connect a pressurized air supply source 13 and a pressurized oil supply source 14 to the hammer 12 by means of an oil pipe 15 as shown in FIG. 3. The punch body 4 is provided with a main oil passage 16 and a branch oil passage 17. As can be seen in FIG. 3 the passages 16 and 17 are disposed such that they are effective to feed lubricating oil to the upper tool 3 and the space between the punch body 4 and the sleeve 5. Furthermore, the sleeve 5 is formed with an oil passage 18 extending from the space between the punch body 4 and the sleeve 5 to the space between the sleeve 5 and the upper turret 2 so as to further supply lubricating oil to the space between the sleeve 5 and the upper turret 2.

Although hand lubrication has the advantage of being relatively inexpensive in cost, the disadvantage of hand lubrication is that the labor required therefor is not negligible. Furthermore, one is occasionally so absent-minded that he fails to carry out hand lubrication. The automatic lubrication described in the preceding paragraph also has its merits and demerits. Although the automatic lubrication serves to improve the working efficiency, the alterations required to adapt the apparatus for automatic lubrication involve high installation costs. Another disadvantage to the automatic lubrication is that it is impossible to feed both lubricating oil and cutting oil to the proper places at the same time. Still another disadvantage to automatic lubrication is that the products and the equipment are fouled and the work environment is spoiled by pressurized oil splashing out of the apparatus.

Yet still another disadvantage to automatic lubrication is that it is difficult to set the rate of oil flow and the timing of oil outflow in a CAM system, such that the oil feed cannot be smoothly and precisely effected.

Thus, none of the prior art apparatuses is capable of satisfactorily feeding cutting oil to the upper tool and the lower tool. In order to prevent these tools from seizing up on each other, it is common to either make do with lubricating oil in place of cutting oil or to apply cutting oil to the surfaces of the material so that at least a small portion of the cutting oil may be supplied to the cut edges of the material.

SUMMARY OF THE INVENTION

The present invention is based on a concept that, in order to improve working efficiency and product quality and make the turret punch press more durable, it is desirable to feed generous streams of the proper kinds of oils to the proper places. It is an object of the present invention, therefore, to provide a method and an apparatus of the general type described above which retains the above-mentioned desirable characteristics. It is another object of the present invention to provide a method and an apparatus by which effective and smooth oil feed can be effected without spoiling the work environment.

To accomplish the above-described objects, a method in accordance with the present invention comprises the steps of fixedly placing, in a prescribed position in a lower turret, a cylindrical die in which a lower tool is formed, providing an upper tool and upper turret to support the upper tool in such a manner as to allow the upper tool to be repeatedly moved vertically, disposing the upper tool over the lower tool so that the upper tool, when vertically lowered, may fit in the lower tool, feeding lubrication oil by a suitable means to the sliding contact surface of the upper tool, positioning a flat material on the upper face of the cylindrical die so as to allow the flat material to mask the lower tool, and feeding atomized cutting oil upwardly from below to a space defined by the flat material and the lower tool.

Further, the present invention relates to an oil feeder for a turret punch press, wherein the turret punch press includes a lower tool member consisting of a lower turret and a cylindrical die which has a lower tool formed in an upper end thereof and which is fastened to the lower turret, and an upper tool member vertically slidably supported by an upper turret and having an upper tool adapted to fit in the lower tool. The oil feeder comprises a lubricating oil feeder means disposed in the vicinity of the contact surfaces at which the upper tool member and a supporting member therefor make sliding contact with one another and a means for feeding atomized cutting oil to the inside space of the cylindrical die.

The contact surfaces at which the upper tool member and the supporting member therefor make sliding contact with one another are fed with lubricating oil suitable for these contact surfaces. A flat material is positioned on the upper face of the cylindrical lower tool member so as to allow the flat material to mask the lower tool member. Suitable cutting oil is fed in an atomized state in the form of upward intermittent spurts from below to a space defined by the flat material and the lower tool member. The flat material masking the lower tool member prevents the cutting oil from splashing to the outside. For the purpose of feeding the upper tool with a generous stream of cutting oil, upward spurts of cutting oil continue to be supplied until the upper tool, after it has been fitted in the lower tool, is moved away from the lower tool.

The above-mentioned and other objects of the present invention are more fully set forth in the following detailed description of a presently preferred embodiment of the present invention, which description is presented with reference to the accompanying drawings.

DESCRIPTION OF A PREFERRED EMBODIMENT

Figure 1:
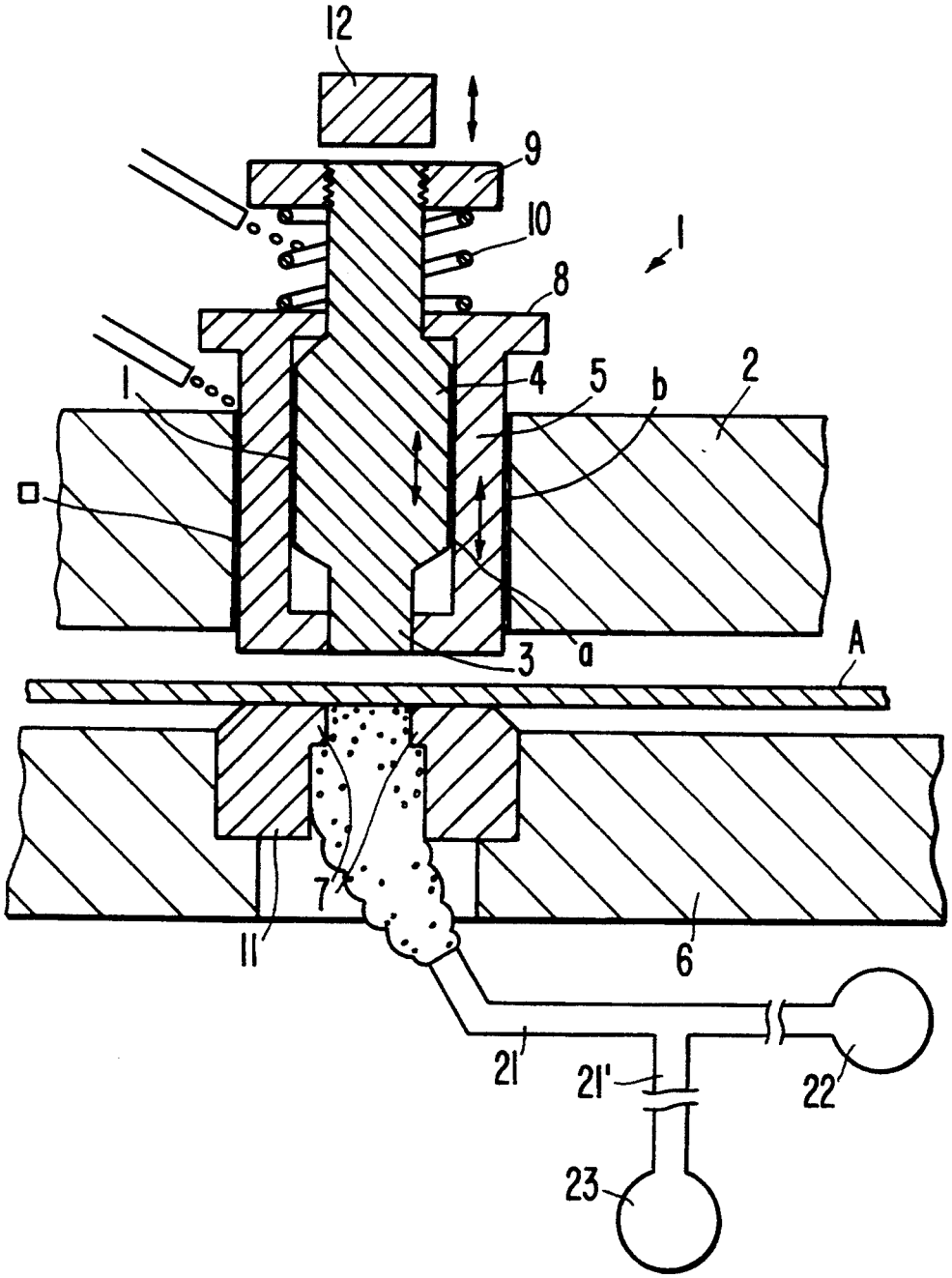
FIG. 1 is a vertical section illustrating an embodiment of an oil feeder according to the present invention for a turret punch press.
Figure 2:
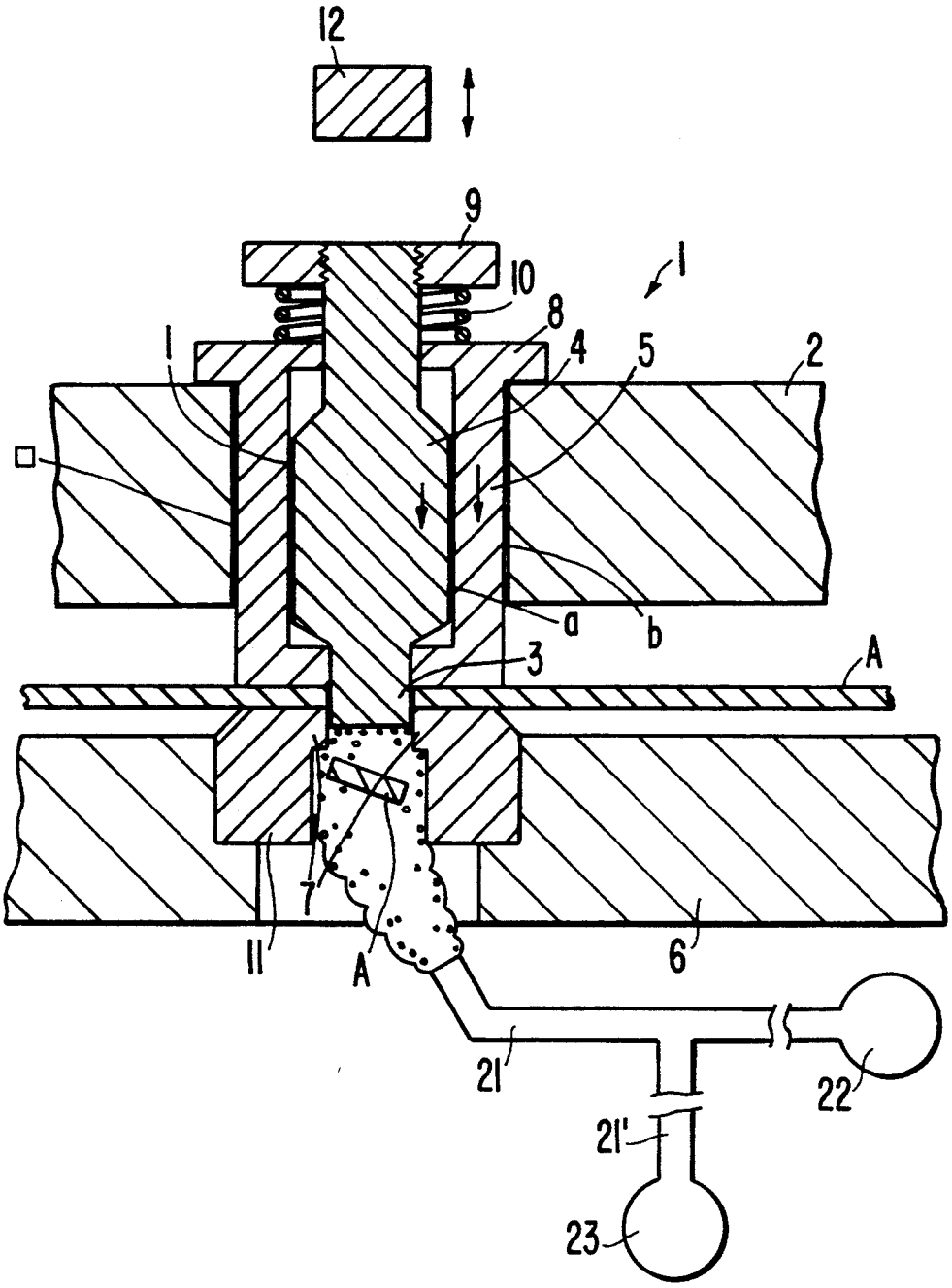
FIG. 2 is a vertical section showing the cooperative relation between an upper tool and a lower tool of the turret punch press.
Figure 3:
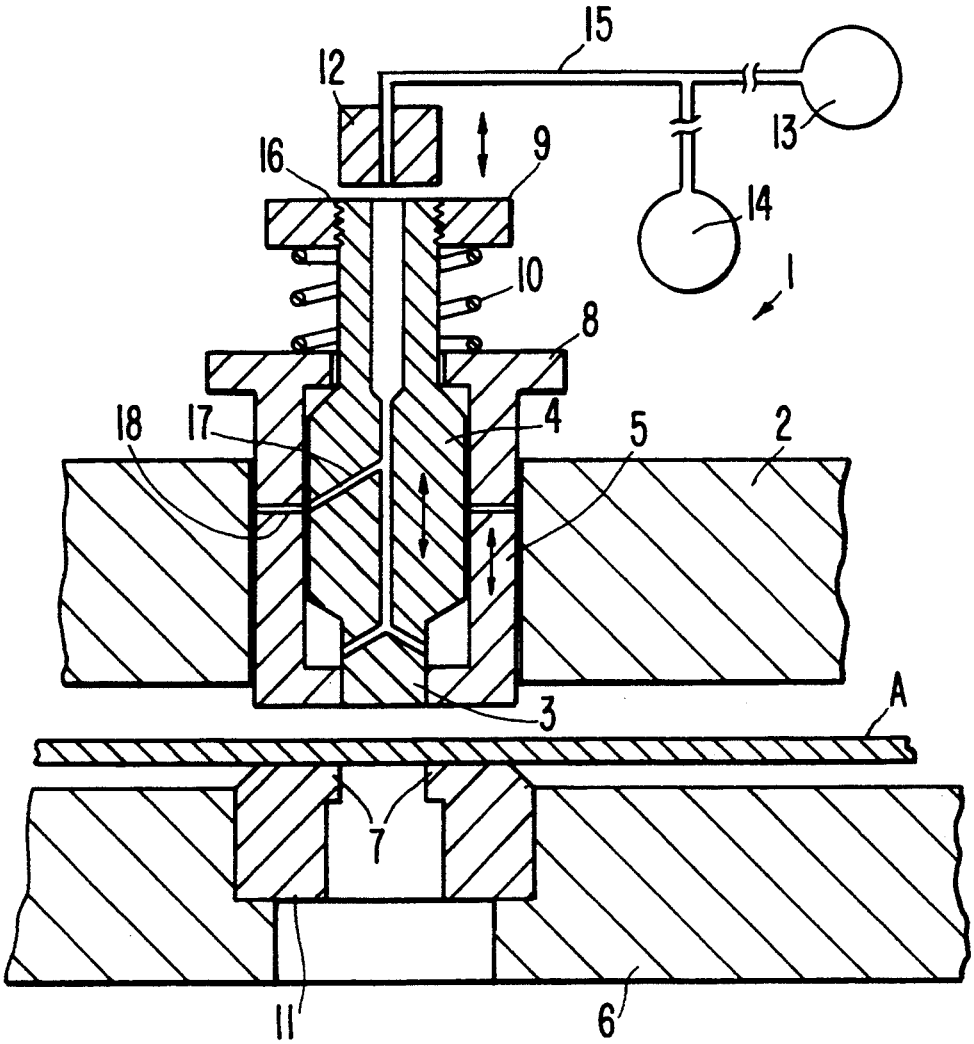
FIG. 3 PRIOR ART
FIG. 3 is a vertical section of a conventional turret punch press.

As shown in FIG. 1, the turret punch press per se is in every respect similar to the conventional turret punch press described above with reference to FIG. 3. In the drawings, like numerals are employed to designate like parts throughout the views. A turret punch press 1 includes an upper rotatable turret (upper support element) 2, a sleeve (supporting member) 5 slidably received in a vertical hole formed in the upper turret 2, and a punch body (or upper tool member) 4 vertically slidably received in the sleeve 5. The punch body 4 has an upper tool 3 formed on its lower end, which is slidably extendable through a lower end of the sleeve 5.

A cylindrical die (or lower tool member) 11 having a lower tool 7 on its upper end is fastened to a lower rotatable turret (lower support element) 6. A flange 8 provided on the upper end of the sleeve 5 determines the extent to which the sleeve 5 can be vertically lowered. A compression spring 10 is interposed between the flange 8 and another flange 9 provided on the upper end of the punch body 4, such that the punch body 4 is biased upwardly. In order to effect punching, a striking force is exerted on the upper end face of the punch body 4 by a hammer 12 disposed over the punch body 4, such that the punch body 4 is vertically lowered to such an extent that the upper tool 3 fits in the lower tool 7. A flat material A is disposed between the upper and lower turrets 2 and 6 and is superposed on the upper face of the lower tool 7 so as to allow the flat material A to mask the cylindrical die 11. In use, the upper tool 3 is vertically lowered against the flat material A to such an extent that the upper tool 3 punches a hole in the flat material A and extends into the lower tool 7.

The contact surfaces a at which the sleeve 5 and the punch body 4 make sliding contact with one another, and the contact surfaces b at which the upper turret 2 and the sleeve 5 make sliding contact with one another are fed with lubricating oil suitable for such contact surfaces. For this purpose, it is common to periodically carry out hand lubrication or, alternatively, use an appropriate pressurized oil supply source.

The present invention consists in the provision of an oil pipe 21, an outlet end of which is disposed immediately below an opening in the bottom surface of the cylindrical die 11. The outlet end of the pipe 21 is directed substantially upwardly toward a space defined by the flat material A and the lower tool 7. The oil pipe 21 is connected at its inlet end to a pressurized air supply source 22. A branch line 21' connects between a cutting oil supply source 23 and a bottom of the pipe 21 intermediate the inlet and outlet ends of the pipe 21.

In operation, cutting oil is supplied by the oil pipe 21 from the moment when the flat material A is positioned to mask the cylindrical die 11. The cutting oil from the oil supply source 23 is mixed with air and is fed in an atomized state in the form of upward intermittent spurts from the pressurized air supply source to the interior of the cylindrical die 11, such that it sticks to the lower tool 7. Then the upper tool 3 is vertically lowered against the flat material A to such an extent that the upper tool 3 punches a hole in the flat material A and extends partially into the lower tool 7, while the interior of the cylindrical die 11 continues to be supplied with atomized cutting oil. As a result, a sufficient amount of the cutting oil is also stuck to the upper tool 3. The supply of atomized cutting oil is cut off at the moment when the upper tool 3 moves upwardly away from the lower tool 7. Thus the periodic supply of cutting oil is timed to the masking of the cylindrical die 11 with the material A. With conventional turret punch presses of this type, it has been difficult to punch a hole in an aluminum plate having a thickness of 3 mm. The present invention eliminates this difficulty by the provision of a method and an apparatus constructed and arranged as described herein. Furthermore, any splashing of the cutting oil to the outside is prevented by the flat material masking the cylindrical die.

Thus, in accordance with the present invention, the means for feeding cutting oil to a space defined by the flat material and the lower tool member is a different means than the means for feeding lubrication oil to the contact surfaces at which the upper tool member and the supporting member therefor make sliding contact with one another. Consequently, it is possible to feed a sufficient amount of both lubricating oil and cutting oil to the proper places in a turret punch press.

Before a hole is punched in the flat material, the upper face of the cylindrical die is masked by the flat material. After a hole is punched in the flat material, the cylindrical die is masked by the upper tool extending into the lower tool. Therefore, the cutting oil will not leak through the upper port of the cylindrical die and the work environment will not become spoiled by oil splashing out of the apparatus.

I claim:

1. A method of feeding oil to a punch press, comprising the steps of:

fixing in place a cylindrical lower tool member having a vertical opening formed therethrough;

positioning an upper tool member above said lower tool member;

vertically slidably supporting said upper tool member with a supporting member disposed above said lower tool member in such a manner that said upper tool member can be lowered to fit into said opening formed through said lower tool member;

feeding lubricating oil to contact surfaces at which sliding contact occurs between said upper tool member and said supporting member;

positioning a material on an upper face of said lower tool member such that said material closes said opening from above; and feeding atomized cutting oil upwardly from below into said opening formed through said lower tool member, such that, when said opening is closed from above by the material or the upper tool member, the atomized cutting oil is prevented from escaping upwardly from said opening.

2. A method as recited in claim 1, further comprising lowering said upper tool member to fit into said opening of said lower tool member, and raising said lower tool member to remove it from said opening; and discontinuing the feeding of the atomized cutting oil when the upper tool member is removed from said opening after being fit thereinto.

3. A method as recited in claim 2, wherein said feeding of the atomized cutting oil is initiated after said material is positioned on said upper face of said lower tool member.

4. A method as recited in claim 1, wherein said feeding of the atomized cutting oil is initiated after said material is positioned on said upper face of said lower tool member.

5. A method as recited in claim 1, wherein said feeding of the atomized cutting oil is carried out in an intermittent spurts.

6. A method as recited in claim 1, wherein said feeding of the atomized oil comprises feeding a mixture of pressurized air and cutting oil.

7. An apparatus for feeding oil to a punch press including a lower support element, a lower tool member fastened to the lower support element and formed of a cylindrical cutting die with a lower tool formed at an upper end thereof, the lower tool member having a vertical opening formed therethrough and being adapted to receive a material covering the vertical opening from above, an upper support element disposed above the lower support element, and an upper tool member vertically slidably supported by the upper support element such that when the upper tool member is lowered, the upper tool member is fit into the opening formed through the lower tool member, said apparatus comprising:

lubricating oil feed means for feeding lubricating oil to contact surfaces at which sliding contact occurs between the upper support element and the upper tool member; and atomized cutting oil feed means for feeding atomized cutting oil upwardly from below into the opening formed through the lower tool member in such a manner that, when the opening is closed from above by the material or the upper tool member, the atomized cutting oil is prevented from escaping upwardly from the opening.

8. An apparatus as recited in claim 7, wherein said atomized cutting oil feed means is operable to discontinue feeding of the atomized cutting oil when the upper tool member is removed from the opening after being fit thereinto.

9. An apparatus as recited in claim 8, wherein said atomized cutting oil feed means is operable to initiate feeding of the atomized cutting oil after a material is positioned on an upper face of the lower tool.

10. An apparatus as recited in claim 7, wherein said atomized cutting oil feed means is operable to initiate feeding of the atomized cutting oil after a material is positioned on an upper face of the lower tool.

11. An apparatus as recited in claim 7, wherein said atomized cutting oil feed means is operable to feed the atomized cutting oil in intermittent spurts.

12. An apparatus as recited in claim 7, wherein said atomized cutting oil feed means comprises a cutting oil supply source, a pressurized air supply source, and an oil feed pipe connected to said cutting oil supply source and said pressurized air supply source and having an outlet end through which the atomized cutting oil is fed.

13. An apparatus comprising:

a punch press including a lower support element, a lower tool member fastened to said lower support element and formed of a cylindrical cutting die with a lower tool formed at an upper end thereof, the lower tool member having a vertical opening formed therethrough and being adapted to receive a material covering the vertical opening from above, an upper support element disposed above said lower support element, and an upper tool member having an upper tool and being vertically slidably supported by said upper support element such that when said upper tool member is lowered, said upper tool is fit into said vertical opening of said lower tool; and atomized cutting oil feed means for feeding atomized cutting oil upwardly from below into the opening formed through the lower tool member in such a manner that, when the opening is closed from above by the material or the upper tool member, the atomized cutting oil is prevented from escaping upwardly from the opening.

14. An apparatus as recited in claim 13, wherein said atomized cutting oil feed means is operable to discontinue feeding of the atomized cutting oil when said upper tool is removed from the opening after being fit thereinto.

15. An apparatus as recited in claim 14, wherein said atomized cutting oil feed means is operable to initiate feeding of the atomized cutting oil after a material is positioned on an upper face of said lower tool.

16. An apparatus as recited in claim 13, wherein said atomized cutting oil feed means is operable to initiate feeding of the atomized cutting oil after a material is positioned on an upper face of said lower tool.

17. An apparatus as recited in claim 13, wherein said atomized cutting oil feed means is operable to feed the atomized cutting oil in intermittent spurts.

18. An apparatus as recited in claim 13, wherein said atomized cutting oil feed means comprises a cutting oil supply source, a pressurized air supply source, and an oil feed pipe connected to said cutting oil supply source and said pressurized air supply source and having an outlet end through which the atomized cutting oil is fed.

19. An apparatus as recited in claim 13, further comprising lubricating oil feed means for feeding lubricating oil to contact surfaces at which sliding contact occurs between said upper support element and said upper tool member.

* * * * *